US007320573B2

(12) United States Patent
Jones, Jr. et al.

(10) Patent No.: US 7,320,573 B2
(45) Date of Patent: Jan. 22, 2008

(54) METHOD FOR PACKAGING ARTICLES HAVING VARYING THICKNESSES

(75) Inventors: Theodore E. Jones, Jr., Morris Township, NJ (US); William A. Blain, Chestnut Ridge, NY (US); Steve A Ramos, Victorville, CA (US); Edward Drake, Jr., Atlanta, GA (US)

(73) Assignee: Kraft Foods Holdings, Inc., Northfield, IL (US)

( * ) Notice: Subject to any disclaimer, the term of this patent is extended or adjusted under 35 U.S.C. 154(b) by 546 days.

(21) Appl. No.: 10/631,360

(22) Filed: Jul. 31, 2003

(65) Prior Publication Data

US 2004/0022618 A1 Feb. 5, 2004

Related U.S. Application Data

(62) Division of application No. 09/870,575, filed on May 31, 2001, now Pat. No. 6,640,523.

(51) Int. Cl.
*B66C 23/00* (2006.01)
*B65B 35/30* (2006.01)

(52) U.S. Cl. ..... 414/790.3; 53/540; 53/152; 414/797.9

(58) Field of Classification Search ..... 414/796.1, 414/797.7, 795.1, 796, 796.6, 797.9, 497; 53/540, 504, 152, 154, 532; 198/418.3, 418.6; 99/450.1, 450.4
See application file for complete search history.

(56) References Cited

U.S. PATENT DOCUMENTS 2,708,863 A 5/1955 Payne
2,770,392 A 11/1956 Roberts
2,872,020 A 2/1959 Hansel et al.
3,088,604 A 5/1963 Nilsson
3,124,059 A 3/1964 Labombarde
3,195,739 A 7/1965 Hein et al.
3,331,516 A 7/1967 Gübeli
3,338,370 A * 8/1967 Maulini ..... 198/418.3
3,403,033 A 9/1968 Griner
3,429,416 A 2/1969 Provost et al.
3,488,917 A 1/1970 Oswald et al.

(Continued)

*Primary Examiner*—Saul Rodriguez
*Assistant Examiner*—Gregory W Adams
(74) *Attorney, Agent, or Firm*—Greenblum & Bernstein, P.L.C.

(57) ABSTRACT

A system for continuously packaging or sorting fragile articles having varying thicknesses in a stack includes a plurality of proportional shifters coupled to each of a plurality of stripping devices in an article infeed assembly. Each proportional shifter has an article gauge for measuring the height of a stack having a set or desired number of fragile articles, such as crackers or cookies. An article stripping device may be quickly and accurately adjusted in-process to measure the thickness of a set number of stacked articles contained in a given batch coming from an article infeed. The article gauge provides a measure of the height of a stack of a set number of articles sampled from an article infeed. The stack height is equivalent to the height of the stack of articles stripped by the strip feeder. Once an adjustment has been made for the correct thickness, the system allows a step for switching in-process the number of articles stripped between two different pre-determined numbers of articles in a stack, for example three and four, while maintaining the thickness adjustment. The system and method of the present invention prevent breakage and waste in packaging or sorting fragile articles having thicknesses which vary over time in a stack.

28 Claims, 8 Drawing Sheets

U.S. PATENT DOCUMENTS 3,638,538 A 2/1972 Sullivan
3,641,735 A 2/1972 Daily et al.
3,748,797 A 7/1973 Deines
3,874,522 A 4/1975 Rana
3,921,827 A 11/1975 Joice
4,013,179 A 3/1977 Fluck
4,162,870 A 7/1979 Storm
4,209,960 A 7/1980 Deutschlander et al.
4,282,964 A 8/1981 Hogenkamp et al.
4,364,467 A * 12/1982 Blakelock ..... 198/429
4,421,019 A 12/1983 Hocking et al.
4,432,685 A 2/1984 Stauber
4,457,665 A 7/1984 Fluck
4,544,315 A 10/1985 Muskulus
4,547,112 A 10/1985 Steinhart
4,712,356 A 12/1987 Hardage et al.
4,736,570 A 4/1988 Hardage et al.
4,827,698 A 5/1989 Banks
4,966,521 A * 10/1990 Frye et al. ..... 414/788.8
5,010,715 A 4/1991 Fluck
5,069,019 A 12/1991 Lodewegen
5,078,255 A 1/1992 Haley
5,095,684 A 3/1992 Walker et al.
5,235,796 A * 8/1993 Campbell et al. ..... 53/535
5,287,952 A 2/1994 Redaelli
5,308,223 A 5/1994 Sternheimer et al.
5,460,843 A 10/1995 Greene
5,640,833 A 6/1997 Gerber
5,761,883 A 6/1998 Pruett et al.
5,823,738 A 10/1998 Spatafora et al.
5,829,954 A 11/1998 Pruett
5,893,701 A 4/1999 Pruett
6,131,372 A 10/2000 Pruett
6,189,678 B1 * 2/2001 Loewenthal et al. ..... 198/418.3
6,438,925 B1 8/2002 Straub

* cited by examiner

METHOD FOR PACKAGING ARTICLES HAVING VARYING THICKNESSES

This application is a divisional application of U.S. Ser. No. 09/870,575, filed May 31, 2001 now U.S. Pat. No. 6,640,523, which is incorporated by reference in its entirety.

FIELD OF THE INVENTION

The present invention relates to a system and method for continuously packaging in a stack fragile articles which have varying thicknesses. The system comprises a plurality of gauges for measuring the stack height of a set or desired number of fragile articles and a plurality of proportional shifters for shearing out a pre-determined number of articles from an article feed stack and for setting and switching the predetermined number of articles from among two different pre-determined numbers.

BACKGROUND OF THE INVENTION

In packaging or sorting articles in a stack, an infeed of the articles in the form of a stack is passed to a strip feeder which strips or shears a certain number of articles from the bottom of the feed stack or the leading edge of the feed stack. Stripping the articles from the feed stack comprises shearing the article stack by a stripper means, including, for example, a strip feeder having a stripper lug to shear the desired number of articles from the feed stack for packaging. In this fashion, the stripper lug "picks" a desired number of articles from a feed stack. However, the stack of articles removed by a typical strip feeder is limited in size by a fixed guide means positioned to allow the stripper means to pass just underneath of the guide, thereby shearing articles from a feed stack. Thus, a typical strip feeder provides a specific stack height which matches a preset number of articles to be packaged in a "one size fits all" fashion. Accordingly, if the articles become thicker over time, the strip feeder will break articles that impinge against the bottom or side of the fixed guide means, will successfully strip fewer than the desired number of articles from the infeed, and may cause jamming in the feed stack. Where the articles tend to become thinner over time, the stripper lug will tend to shear more than a desired number of articles from a feed stack, or break articles that abut the fixed guide means during stripping. In addition, the breakage of articles from a feed stack invariably results in the clogging and stoppage of a packaging or sorting assembly which causes time delays and greatly adds to the expense of processing and packaging the stacked articles.

In a typical packaging operation, a single packaging or sorting assembly comprises multiple infeed lines. Often product thicknesses vary between the different infeed lines in a given packaging assembly. For example, for baked crackers, cookies, and biscuits, the actual thickness of the product will vary across the width of an oven band so that the product on the edges of an oven are thinner than the product in the center of the oven where leavening or where thermal expansion is maximized. An infeed and packaging assembly can be adapted to package only that series of cookies, crackers or biscuits which are baked in a specific row or lane of the oven so that, for instance, only the crackers, cookies or biscuits which are baked adjacent the left-hand side of the oven are packaged in a specific product infeed and packaging assembly. However, each new batch of dough will result in a slightly different product differing in thickness from the product of the previous batch. Accordingly, even an infeed and packaging assembly which is arranged to package a specific row of product will ultimately break down or fail in shearing a desired number of product articles from an infeed stack due to changes in thickness in the articles.

To minimize damage to a feed stack of articles, a strip feeder can be set to pick only a small number of articles from the feed stack to send to further processing. However, a packaging or sorting assembly for cookies, crackers or biscuits, for example, usually is adapted to package ten or more of such articles in a "slug". In such an instance, the stack of articles moved by a typical strip feeder does not strip enough articles to make up the slug. As a result, several strip feeders must be arranged within a packaging assembly that feeds a given wrapper. For example, three strip feeders can be arranged upstream of a single wrapper so that three separate "stripped" stacks of articles can then be combined to make a single "slug" or stack of articles for wrapping or sorting. However, any time one of the feed stacks or strip feeders clogs or breaks down, it will idle the entire assembly feeding a given wrapper, no matter whether there is a problem in the other feed stacks or strip feeders.

An infeed supply problem also results when a strip feeder assembly having three strip feeders is designed to create a slug having ten articles in a stack. In such an example, two of the strip feeders will pick three articles from a feed stack and one of the strip feeders will pick four articles from a feed stack. As a result, the backlog or supply of articles in the infeed supplying the strip feeder which picks four articles will run out of product before the backlog or supply of articles in the infeed for the two strip feeders set to pick three articles. Accordingly, it is necessary to set the strip feed assembly to pick four articles from alternating stacks. A conventional shifter shifts a stack support downwardly so as to permit four articles, instead of three, to pass under the stack guide means and be picked from the stack. An article sensor system comprising photoelectric eyes or vision technology may be used to sense or detect the extent of backup or supply of shingled articles on the conveyor system upstream of the shifter for automatically determining when the shift should be made for each line.

The automatic shifting to change the number of articles picked from the stack is by a pre-fixed amount, which may be equal to or slightly greater than the average article thickness. However, with a conventional shifter, the amount shifted is not adjusted for any changes in thickness of the individual articles. Accordingly, a change in article thickness may result in jamming or product breakage when the shifter is set for picking either of its two preset number of articles, e.g. when the shifter is set for either three or four articles. Also, resetting the article picking clearance to fit a change in article thickness for a given number of articles, would not automatically correct or proportionally change the clearance for another given number of articles where the amount of shift is pre-fixed or preset. Moreover, with a conventional shifter, to change the amount of shift, each line feeding the wrapper would have to be shut down for a substantial period of time thereby idling production.

The present invention provides a strip feeder system in a packaging or sorting assembly which allows the user to adapt the system to "pick" a desired number of articles having a thickness which changes over time from an article feed. The strip feeder system allows one to switch the number of articles picked from an article infeed stream to a different number during processing while automatically proportionally compensating for changes in article thickness. A plurality of proportional shifters are employed to switch the number of articles picked by a strip feeder during processing and each proportional shifter is equipped with an article gauge to adjust article thickness as it changes during processing. Multiple article feed streams derived from a common source such as a band oven, may be fed via a plurality of shifters to a single wrapper, packaging or sorting assembly. Breakdowns or shutdowns in any portion of the assembly are avoided by allowing an adjustment for changes in article thickness without interrupting the flow of articles. The present invention provides a system and method for continuously packaging or sorting fragile articles such as crackers and cookies, having varying thicknesses in a stack where the individual article thickness may vary across multiple supply lines and also within a given supply line. In accordance with the present invention adjustments can be made for variation in article thickness and variation in supply line backup for a plurality of supply lines which feed a single wrapping or packaging machine while avoiding the need to shut down the supply to the packaging machine thereby substantially reducing idle time, product waste and scrap.

SUMMARY OF THE INVENTION

The article gauge and proportional shifter system of the present invention provides a plurality of proportional shifters each coupled to one of a plurality of stripping devices for the removal of articles from a feed stack in an article infeed assembly. The system may be employed to continuously package and/or sort in a stack fragile articles having a thickness which varies over time. In the system of the present invention, each proportional shifter unit has an article gauge adapted to measure the stack height of a set number or plurality of fragile articles sampled from an infeed, for example a given batch of articles. The proportional shifter is adapted to set the number of articles for removal from a feed stack while the infeed assembly is in continuous operation. Accordingly, the system of the present invention provides a means for quickly and accurately adjusting an article stripping device in-process to continuously measure the thickness of a set number of stacked articles contained in a series of batches coming from an article infeed. In addition, once an adjustment has been made for the correct thickness, the system is able to change or switch in-process the number of articles stripped between two different pre-determined numbers of articles in a stack, for example three and four, while maintaining the thickness adjustment.

In a preferred embodiment of the system of the present invention, a rotary material stripper (RMS) assembly or rotary motion shuttle (RMS) feeder assembly, comprising three article gauge and proportional shifter units of the present invention and three RMS feeders associated therewith, are mated with each single wrapper unit in a packaging or sorting assembly comprising a plurality of wrapper units.

The article gauge of the system of the present invention can be used either with conventional strip feeders or with the proportional shifter as part of a strip feeder in an article infeed assembly. The article gauge measures the height of a stack of a set number of articles having an assumed thickness which is equivalent to the height of the stack of a set number of articles stripped by the strip feeder. Further, the article gauge allows for a change in the height of a stack of a set number of articles in proportion to the number of articles stripped without interrupting the flow of articles. Accordingly, where the article gauge and the proportional shifter are used in combination, an in-flow adjustment in the stack height of a set number of articles in the gauge allows the user to shift between two pre-determined numbers of articles to be stripped while maintaining the adjustment in stack height and without interrupting the flow of articles.

In embodiments of the invention, fragile articles, such as crackers, cookies, or other baked goods having varying thicknesses from each other may be continuously packaged or sorted in a stack by feeding each of a plurality of stacks of articles supplied from an article infeed to one of a plurality of stripping devices, setting a plurality of proportional shifters each coupled to one said stripping device to remove a set number of articles from each feed stack in said infeed, and measuring the stack height of said set number of articles with an article gauge attached to each proportional shifter. Each proportional shifter may be shifted between two different pre-determined numbers of fragile articles to be removed from its feed stack.

DETAILED DESCRIPTION OF THE INVENTION

The present invention provides a system and method for continuously packaging or sorting fragile articles such as crackers, cookies, and other baked goods having varying thicknesses in a stack where the individual article thickness may vary across multiple supply lines and also within a given supply line. Adjustments can be made for variation in article thickness and variation in supply line backup for each of a plurality of supply lines which feed a single wrapping or packaging machine while avoiding the need to shut down the supply to the packaging machine thereby substantially reducing idle time, product waste and scrap. The system and method of the present invention substantially reduces product breakage in each packaging supply line from a continuous band oven caused by variations in product thickness across the width of an oven band and along the length of an oven band.

The article gauge and proportional shifter system of the present invention provides a means for quickly and accurately adjusting each of a plurality of article stripping devices to measure the thickness of a set number of stacked articles stripped from a plurality of in-feeds or chutes which continuously deliver a series of batches of the articles for packaging or sorting. In addition, once an adjustment has been made for the correct thickness of a set number of articles in a given batch, the system is able to switch in-process the number of articles stripped between two different pre-determined numbers of articles in a stack, for example three and four articles, during use of the article infeed assembly while maintaining the thickness adjustment. Accordingly, each proportional shifter shifts between two pre-determined numbers of articles in a stack of articles to be removed by an article stripper, one of which is the set number of articles, while the article gauge measures the height of the said set number of articles.

The term "set number of articles in a stack" can be, for example, from about 2 to about 6 articles. The term "pre-determined number of articles in a stack" refers to two different whole numbers of articles in a stack wherein one of the pre-set numbers is the same as the set number of articles in a stack, for example, from about 2 to about 6 articles.

The term "in-process" refers to an operation conducted without interrupting a packaging or sorting process or without stopping the system or assembly used in the present invention.

The term a "plurality" when used to refer to proportional shifter and gauge units, or a plurality of rotary material stripper (RMS) feeders, or rotary motion shuttle (RMS) feeders, RMS feeder assemblies, or wrappers may mean from about 2 to about 12 of such units, feeders, assemblies, or wrappers. A "plurality" when used to refer to rows of article infeed may mean from about 2 to about 30 such rows.

Figure 1:
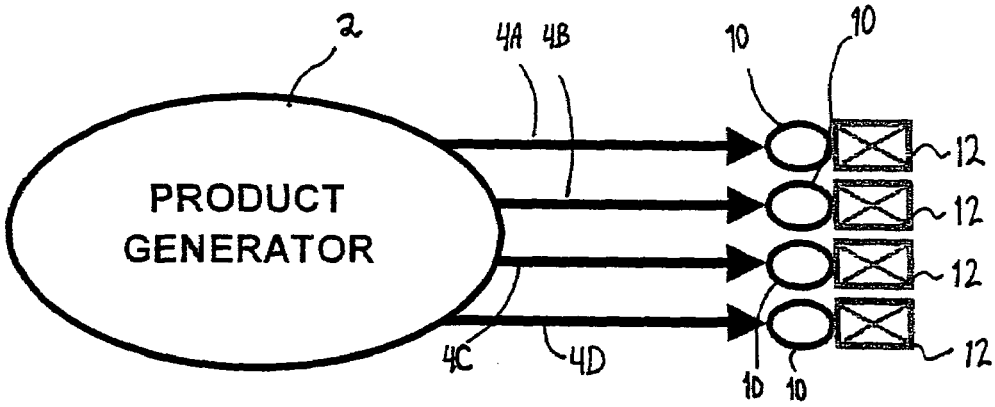
FIG. 1 depicts a block diagram of an article gauge and proportional shifter system of the present invention.

As shown in FIG. 1, a product generator 2, such as a band oven, continuously generates a plurality of rows 4A, 4B, 4C, and 4D of product, such as graham crackers. To provide the benefits of the article gauge and proportional shifter system of the present invention, a gauge and shifter unit 10 is coupled to each stripping device 12, as shown in FIG. 1. This produces a system that provides the means for quickly and accurately adjusting the stripping devices for multiple product streams 4A, 4B, 4C, and 4D from the product generator 2. For example, where a new batch of cracker dough is fed to an oven and hence a wrapper or sorter every 15 to 25 minutes, each of the stripping devices in the system of the present invention may be adjusted every 15 to 25 minutes during continuous use to compensate for variations in article thickness caused by feeding of a new batch of dough to the oven. In FIG. 1, the article or cracker thickness may change within in each product stream 4A, 4B, 4C, and 4D when the batch of dough is changed. In addition, product thickness across the oven band generally varies. The product thickness in the outer product streams 4A and 4D is generally less than the product thickness in the inner product streams 4B and 4C because less oven heat is available to product in the outer product streams.

Figure 2:
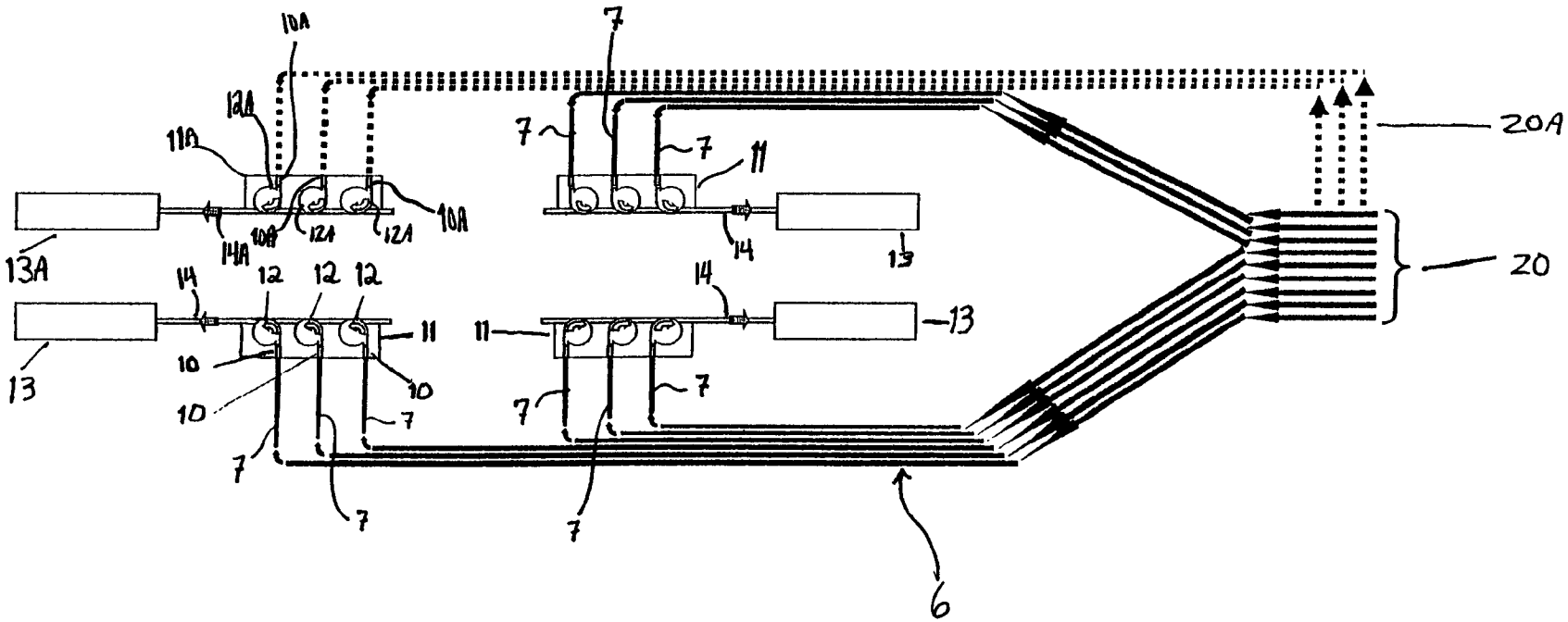
FIG. 2 depicts a block diagram of an embodiment of an infeed assembly leading from an oven to a plurality of wrapping machines, each of which is fed by a plurality of proportional shifters and article gauges.
Figure 4:
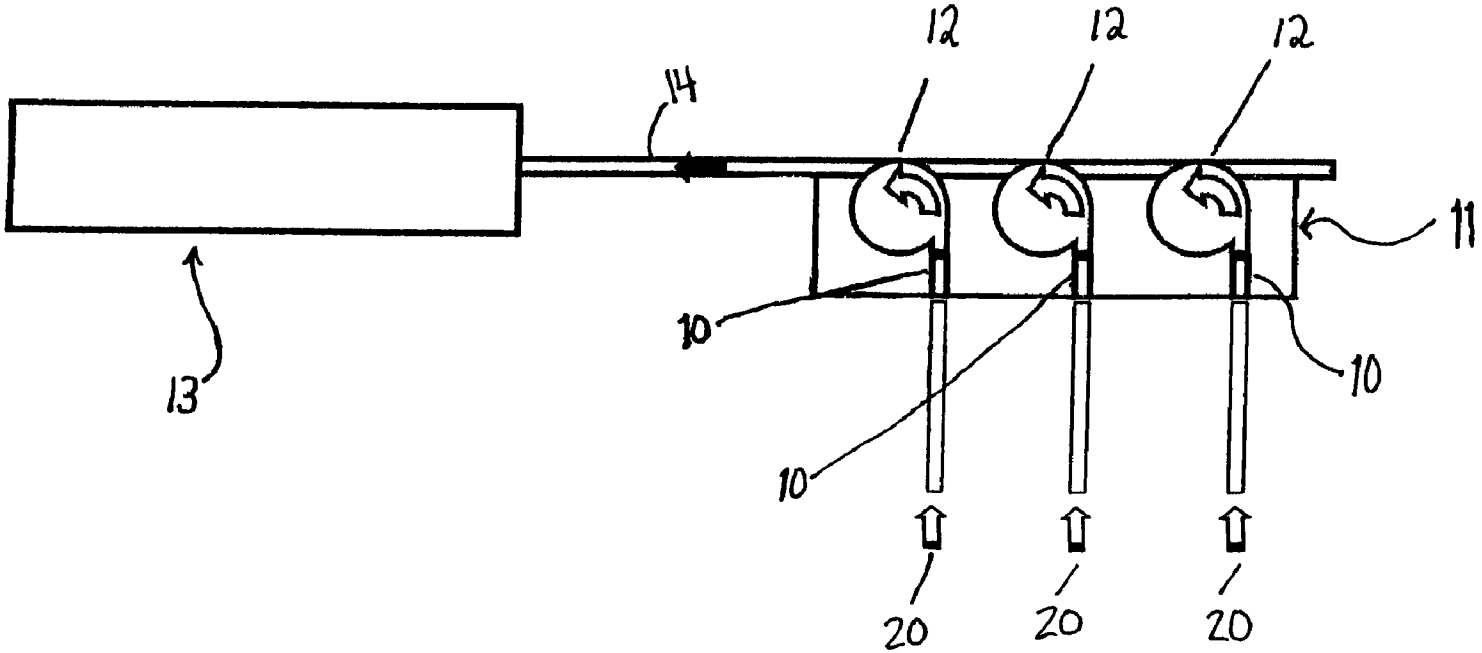
FIG. 4 depicts an RMS feeder assembly having three rotary material stripper (RMS) feeders and three proportional shifter and gauge units per wrapper.

FIG. 2 shows a system for continuously packaging or sorting fragile articles having varying thicknesses in a stack. In FIG. 2, nine rows of product 20, such as graham crackers, are continuously fed from a single band oven, for example on an oven band, to an article infeed assembly 6. The infeed assembly 6 includes separate, continuous product infeed or conveyor means 7 which feed into a plurality of rotary material stripper or RMS feeder assemblies 11 and from there into three wrappers 13. Each wrapper 13 is fed by a RMS feeder assembly 11 which includes a series of three RMS feeders 12 as shown in FIGS. 2 and 4, each having a proportional shifter and gauge unit 10. The system may also have a spare wrapper 13A including one or a plurality of RMS feeder assemblies 11A, for example a single assembly 11A, which comprises three spare RMS feeders 12A and three spare proportional shifter and gauge units 10A. Product 20A from the oven can be diverted to the spare wrapper 13A to accommodate a product infeed when one of the three wrappers 13 stops or breaks down.

In FIG. 2, three RMS feeders 12 and three proportional shifter and gauge units 10 are mated with one wrapper 13. All three RMS feeders 12 may interface with the wrapper 13 in exactly the same way, except the stacks are stripped at different levels or heights relative to the wrapper conveyor 14 so as to permit progressive stacking of the stripped stacks from the three feeders on each other. In embodiments of the present invention, a plurality of RMS feeders 12 combined with proportional shifter and gauge units 10, or a plurality of RMS feeder assembles 11, may be mated with one or a plurality of wrappers 13.

In embodiments of the present invention, the article gauge and proportional shifter unit 10 may be located on the article infeed relative to the RMS feeder 12 so that the RMS feeder 12 may effectively push a stack having a pre-determined number of articles, for example 3 or 4, from the proportional shifter and gauge units 10 to transfer the said stack into wrapper 13 or onto a conveyor 14 which feeds wrapper 13. The conveyor 14 may be separate from or may be integral with or comprise part of wrapper 13.

In the embodiment shown in FIG. 2, three RMS feeders 12, conveyor 14 and wrapper 13 are arranged so that, moving in a downstream fashion, a second feeder puts a stack having a pre-determined number of articles on top of the stack of articles fed onto the conveyor 14 by the first feeder, and a third feeder puts another stack having a pre-determined number of articles on top of the stack formed on the conveyor by said first and second feeders to form a slug. The stack of articles formed by the three RMS feeders 12 is called a "slug." In continuous operation, then the system of the present invention feeds a series of slugs into one or a plurality of wrappers. A slug comprises a desired number of articles, for example ten graham crackers, which will be packaged as a single unit by a wrapper. A slug may comprise from about 3 to about 30 articles. Where three RMS feeders 12 feed a single wrapper 13, the slug may have from about 6 to about 18 articles.

Figure 3:
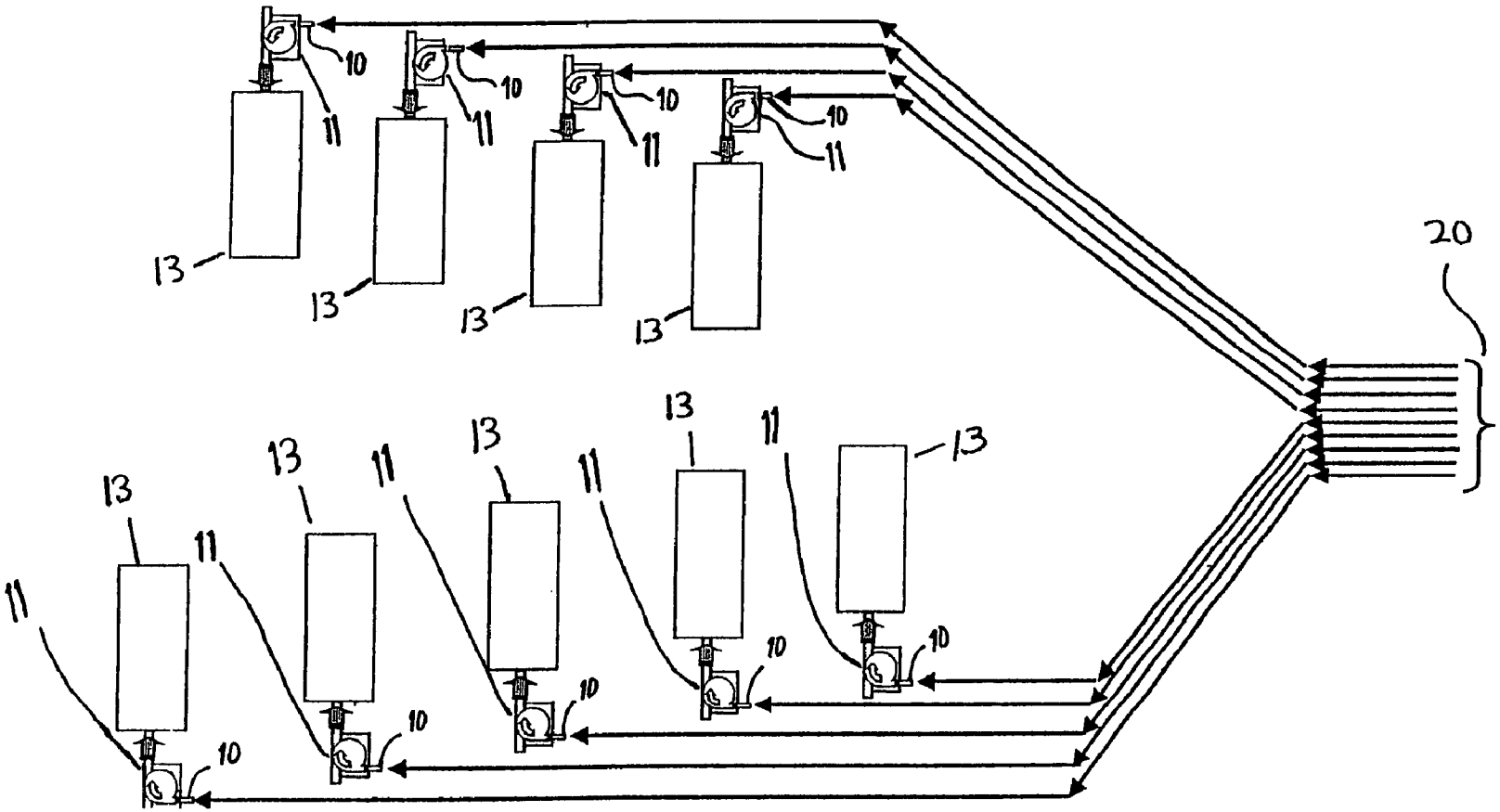
FIG. 3 depicts a block diagram of another embodiment of an infeed assembly leading from an oven to a plurality of wrapping machines, each of which is fed by a single proportional shifter and article gauge.

In an alternative embodiment of the present invention, shown in FIG. 3, an RMS feeder assembly 11 may comprise one RMS feeder 12 and one proportional shifter and gauge unit 10 per wrapper 13. Since there is only one RMS feeder 12 per wrapper 13, a stack of, for example, eleven articles cannot be built up by having the second or middle RMS feeder 12 put articles on top of the articles fed by the first or upstream RMS feeder 12, and having the third or downstream RMS feeder 12 put articles on top of those fed by the first and second RMS feeders 12. Therefore, one would have to make a stack of perhaps three or four articles, a smaller package.

In a preferred embodiment of the present invention, shown in FIG. 4, an RMS feeder assembly 11 of the article gauge and proportional shifter system of the present invention comprises three RMS feeders 12 per wrapper 13. In the RMS feeder assembly 11, each of the three proportional shifter and gauge units 10 may be associated with separate product chutes from which the three separate RMS feeders 12 strip out or shear a stack of articles.

In operation of the RMS assembly 11, an RMS feeder 12 strips out a predetermined number of articles removed from a stack of articles and continuously sweeps them into the infeed of the wrapper 13. An RMS feeder 12 may comprise a disc that rotates horizontally in a circle, with groups of retractable fingers sticking out substantially vertically from the top of the rotatable disk. For example, an RMS feeder 12 may comprise a rotatable disc having at least one group of three square metal fingers radially arranged on the disc. These three metal fingers are adapted to spring up from the RMS feeder 12 located below the product chute, and strip off a stack having a pre-determined number of articles from the bottom of the stack of articles. The fingers push the stacked articles which are supported on a vertically adjustable article support of the gauge and proportional shifter unit 10 in a substantially horizontal direction from the article support. The rotation of the disk and its attached fingers may be clockwise or counterclockwise, depending on the location of the wrapper 13 relative the RMS feeder 12. As the RMS feeder 12 rotates, it pushes the thus stripped stack of articles to a transfer point adjacent the periphery of the disc, at which point a square metal finger or other pushing means may spring up just upstream of the stack of articles. The pushing means may be part of the wrapper 13 or a conveyor 14 integral with wrapper 13 and may be a square pusher finger that pushes the stack of articles onto conveyor 14 or into the wrapper 13. Accordingly, a hand-off of product from the RMS feeder 12 to the wrapper 13 is accomplished.

Figure 5:
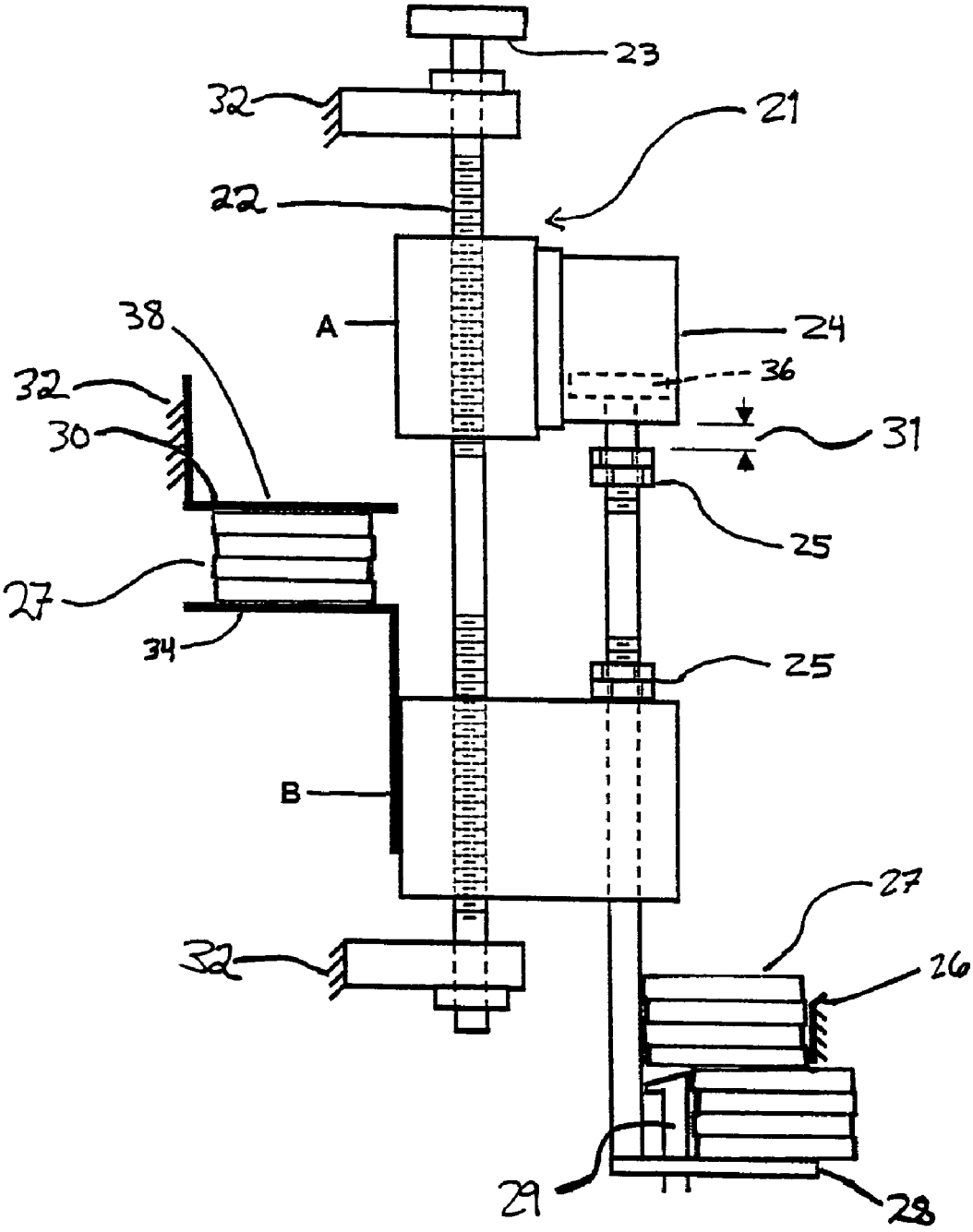
FIG. 5 depicts an embodiment of a proportional shifter and article gauge of the present invention.

Positioned just upstream of the RMS feeder 12 (FIG. 4), the proportional shifter 21, shown in FIG. 5, aids in the stripping out of articles 27 stacked in a column like a roll of coins. Shifter 21 is designed for use with articles that are intended to be uniform in thickness, but which vary over time such as when the articles come from a different batch of dough. Accordingly, shifter 21 is manually adjusted via the article gauge 30 (FIG. 5) one time for a given article and is not adjusted again for so long as the articles that pass through the shifter can reasonably be expected to have a constant thickness. Once the shifter has been adjusted for a given thickness, for example, the thickness of an article from a given batch of dough, shifter 21 is able to change the count of articles stripped between two different counts, e.g. 3 and 4, while maintaining the thickness adjustment.

Figure 6A:
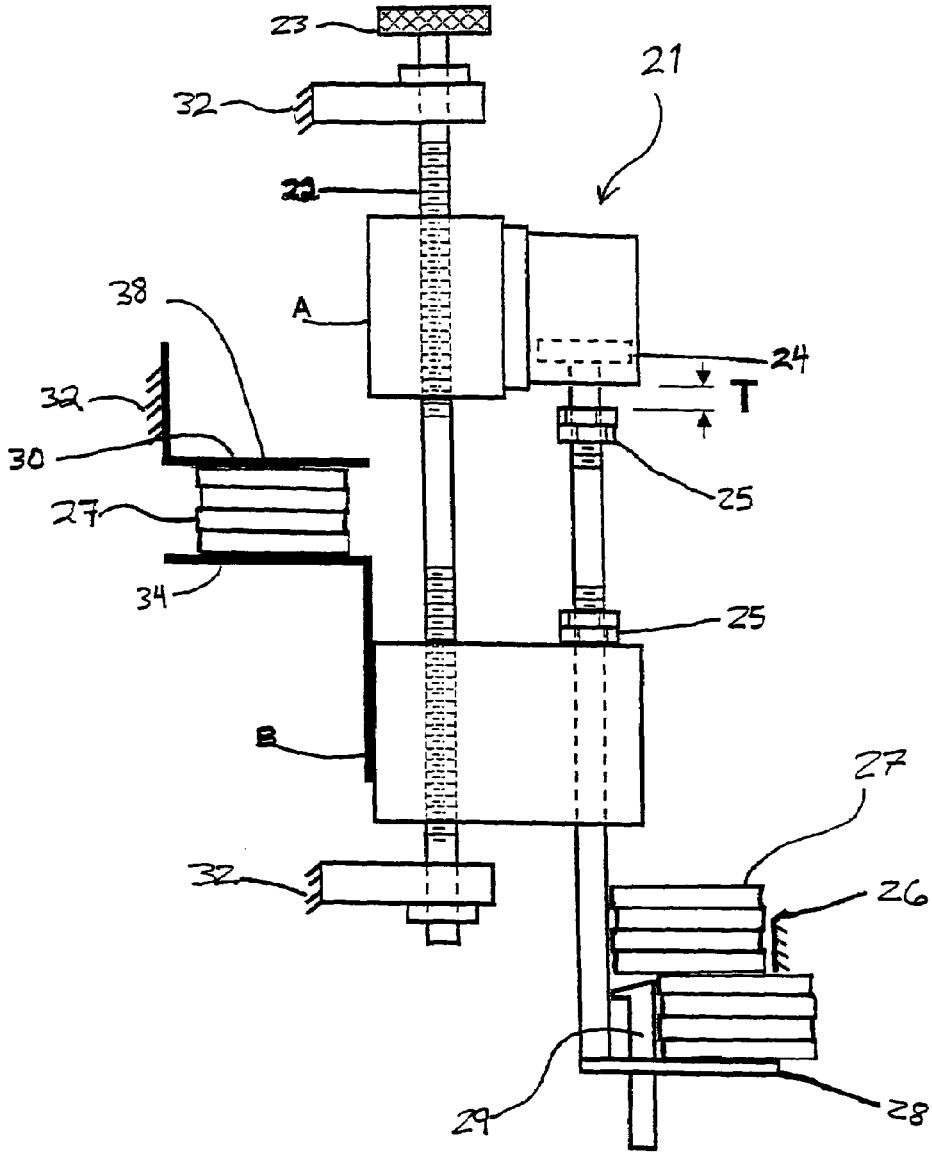
FIGS. 6*a* and 6*b* depict two alternative positions for an article gauge attached to a proportional shifter.
Figure 6B:
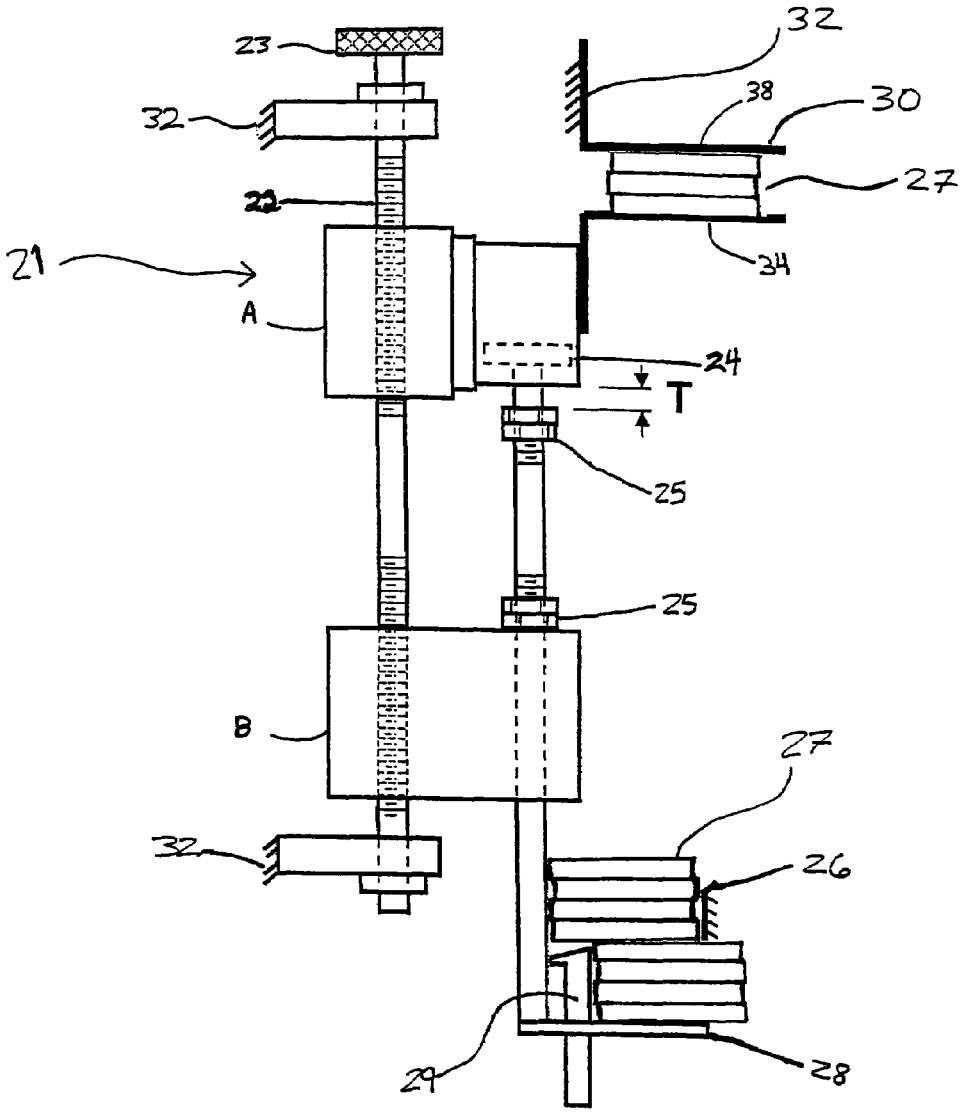
Figure 7:
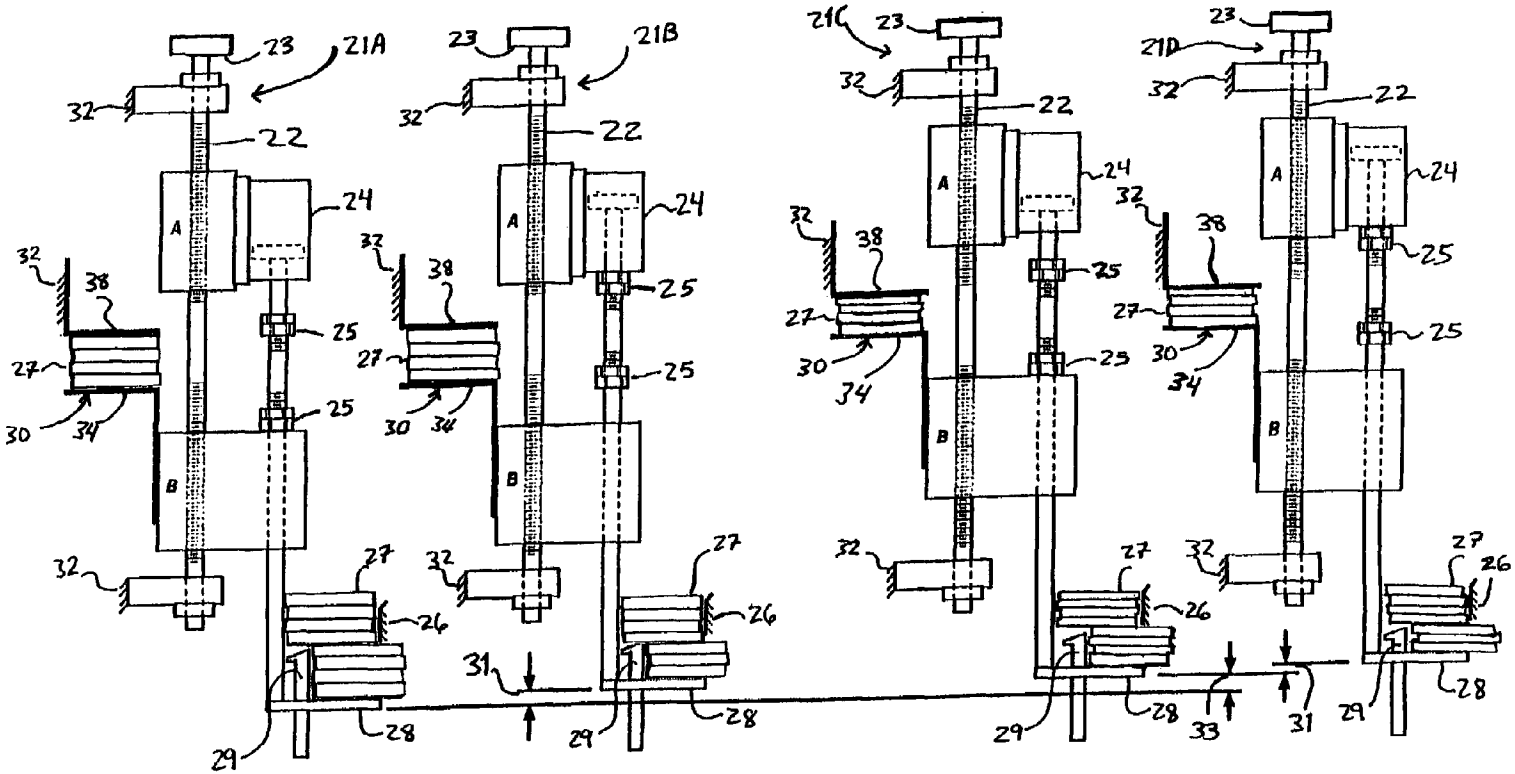
FIG. 7 depicts how the proportional shifter would work with 3- and 4-article picks, and a range of article thickness variation of 0.20 inches to 0.28 inches.

The proportional shifter 21, shown in FIGS. 5, 6A, 6B and the proportional shifter 21A, 21B, 21C, and 21D shown in FIG. 7, comprises an article rest 28 that the stack of articles 27 sits on before being stripped out, a threaded rod 22 with threads of two different pitches, two threaded blocks A and B, and a pneumatic air cylinder 24. The proportional shifter 21 is mounted adjacent an article infeed, product chute or magazine, so that a stripper device strips or shears a pre-determined number of articles from the article rest 28.

The proportional shifter 21 controls article rest 28 by raising or lowering it to measure the height of a stack of one pre-determined number of articles, usually the set number of articles taken from a product infeed. In an embodiment of the present invention, article rest 28 may comprise a group of four horizontally disposed metal fingers having three spaces therebetween. The three spaces between the fingers of the article rest 28 of proportional shifter 21 may be adapted to allow the three square metal fingers that are arranged radially on the disc of the RMS feeder 12 to spring up beneath the article rest 28 and upstream of the stack of articles 27. The fingers of the RMS feeder 12 intermesh with or pass between the fingers of the article rest 28 and act as a stripper lug 29 that effectively strips a desired number of articles from the stack 27. When the operator turns an adjustment knob 23 for the shifter to adjust for thinner articles 27 placed within the article gauge 30 and also located on the article rest 28, the four fingers of the article rest 28 move upward. The upward movement occurs because the stack of articles 27 having a pre-determined number of articles, e.g. four articles, is not as tall as a stack of four thicker articles. Also, the thicker the stack of articles 27 in the gauge 30 and the thicker the articles 27 to be stripped or the larger the number of articles to be stripped off of the article rest 28, the lower the fingers of the article rest 28 must move. When the operator switches proportional shifter 21 to increase the number of articles 27 stripped, for example shifting from three articles to four, the four fingers of the article rest 28 must shift downward. The proportional shifter 21 derives its name because article rest 28 shifts or moves downward a smaller distance for thin articles than for thick articles.

When the proportional shifter 21 has to be switched from one predetermined article count to another, for example between 3 and 4 articles as shown in FIG. 7, a variable stroke piston 36 contained in an air cylinder 24 moves from one position to an alternate position. As a result of the movement of the piston, article rest 28 is raised or lowered by a distance 31 corresponding to an even multiple of the thickness of one of the stacked articles 27, or the average thickness of the articles in the gauge 30 or on the article rest 28. The piston 36 moves as a result of compressed air being directed to one side of the piston 36, and being vented from the other. The compressed air is from an external source.

The stroke or distance moved 31 (FIGS. 5 and 7) by the piston 36 and article rest 28 is limited by pre-determined stroke stops, shown as lock nuts 25 in FIGS. 5, 6A, 6B and 7. The stroke corresponds to the thickness of one article, or "T", as shown in FIGS. 6A and 6B. The stroke stops are positioned during shifter installation and set up so that, if four articles of total thickness 4T are being stripped, then the air cylinder 24 piston stroke will be one quarter of 4T, or T (the thickness of a single article). The piston stroke of the air cylinder 24 in the proportional shifter 21 is variable, and is changed by rotating the thickness adjustment knob 23. If the articles have become thinner over time, then the article rest 28 must be raised to prevent an extra article from being stripped out. Turning the thickness adjustment knob 23 in the appropriate direction raises threaded member or block B, which raises the article rest 28.

The proportional shifter 21 derives its name because article rest 28 shifts or moves downward a smaller distance for thin articles than for thick articles. For example, where shifter 21 is switched from three articles to four and is adjusted to allow for stripping of thinner articles, threaded members or blocks A and B rise different amounts. Threaded block A rises ¾ as much as threaded block B because its thread pitch is ¾ the thread pitch of threaded block B. Accordingly, the distance between threaded block A and B is reduced by an amount of ¼ of the amount that the article rest 28 was raised, and the air cylinder 24 piston stroke is reduced by the same amount. Thus, if the article rest 28 is moved by a distance of U by turning the calibration knob, then the air cylinder 24 piston stroke is reduced by ¼ U. Thus the stroke becomes T—U/4, or the original stroke for one article minus ¼ of the adjustment for four articles. In this manner, shifter 21 remains in perfect adjustment when changing the number of articles being stripped.

In proportional shifter 21, the pitch of the threads on threaded rod 22 must differ on portions or sections of the rod 22 for accommodating or matching the different thread pitches of threaded blocks A and B. The different threads on threaded rod 22 are positioned so that threaded blocks A and B can be positioned to allow for switching between two different pre-determined numbers of articles. The pitch of the threads for blocks A and B differ by a factor equal to the ratio of the two different numbers of articles shifted between or picked. For example, with picks of 3 and 4 articles, the upper thread pitch is ¾ of the lower. In a case of picks between 1 and 2 articles, 2 and 4 articles, 3 and 6 articles, etc., the thread pitch ratio is 1/2. In the case of picks between 2 and 3 articles, the thread pitch ratio is 2/3, and so on.

In operation of the proportional shifter 21, articles 27 fed by an infeed device, such as a chute or magazine, sit on the article rest 28 to be stripped from the bottom of a stack of articles as shown in FIGS. 5, 6A, 6B, and 7. A stripper lug 29 or the three fingers from the RMS feeder 12, shears off the pre-determined number of articles, for example four. A fixed guide 26 located along the article infeed just above the stripper lug 29 prevents the remainder of articles in the infeed from being stripped. In FIGS. 5, 6A, 6B, and 7, the stripper lug 29 moves in a left-to-right direction.

An additional part of the system of the present invention, shown in FIGS. 5, 6A, 6B, and 7, article gauge 30 aids article stripping by providing a means for measuring variations in the thickness of the articles sampled from an article infeed, such as an oven band or conveyor. The article gauge 30 translates this information directly into a correct thickness adjustment for articles having an assumed or target thickness. Further, the article gauge 30 allows for a change in the stack height of a set number of articles in proportion to the number of articles stripped without interrupting the flow of articles. The calibration knob 23 may be turned to raise or lower the article rest 28 while the RMS feeder 12 rotates but in between the time the stripper lug or circumferentially spaced fingers 29 pick, shear, or contact the articles 27.

The article gauge 30 may include two disks or plates 34 and 38, one of which is moved as the operator makes an adjustment for article thickness to the proportional shifter 21. In adjusting the article gauge 30, the operator puts a set number of articles taken from an infeed between the two plates and rotates the thickness adjustment knob 23 on the proportional shifter 21 until the articles just fit in the space between the two plates 34 and 38. This adjustment can be performed during operation of the infeed assembly. The proportional shifter 21 is then in correct adjustment for the articles contained in the gauge 30. The gauge 30 can be manually adjusted for product thickness variations by turning the adjustment knob 23. The articles are placed in the gauge tray or lower plate 34. As the hand turns the knob 23, the space between the tray 34 and the disk or upper plate 38 above the articles increases or decreases. When the articles just fit between the tray 34 and the disk 38, the proportional shifter 21 is correctly adjusted for product thickness.

The article gauge 30 can be used either with conventional strip feeders or non-proportional shifters, or with the proportional shifter 21, as shown in FIG. 5. The article gauge 30 itself measures the height of a stack of a set number of articles having an assumed thickness which is equivalent to the height of a stack of a set number of articles stripped by the strip feeder. Use of the article gauge 30 with a conventional or non-proportional shifter may be similar to use with a proportional shifter 21. However, use of the gauge 30 with a conventional or non-proportional shifter, loses the added ability to adjust the size of the switch between pre-determined numbers in a "pick".

Thus, in preferred embodiments the article gauge 30 and proportional shifter 21 are used in combination, as is shown in FIG. 5. Where the article gauge and a proportional shifter are used in combination, a step for adjusting in-flow stack height of a set number of articles in the gauge 30 allows the user to switch between two predetermined numbers of articles 27 to be stripped while maintaining the adjustment in stack height and without interrupting the flow of articles through the proportional shifter 21 and to the wrapper 13.

In accordance with the present invention, a plurality of gauges 30 and a plurality of proportional shifters 21 may be combined to strip out product from separate streams which continuously flow from a common source, such as an oven. Then the stripped products from some of the streams may be combined into a single stream in stacked form or combined in a common bucket or holding vessel, or bucket conveyer. For example, in embodiments of the invention, a gauge 30 and shifter 21 could strip out four articles, while another gauge and shifter strips out three articles. Combining the output of the two gauge and shifter units 10 would yield seven articles. The shifter feature permits switching one of the gauge and shifter units 10 from stripping four articles to three, and shifting the other from stripping three articles to four without stopping the infeed assembly would maintain a yield of seven articles. This method effectively prevents circumstances where, for example, one backlog or supply feed stack begins to deplete its supply of articles because the proportional shifter and article gauge unit 10 is stripping 4 articles whereas the other unit 10 is only stripping 3. The switching methods according to the present invention can prevent depletion of a plurality of supply feed stacks (e.g. from about two to about six supply feed stacks) relative to one or more other supply feed stacks where differing numbers of articles are stripped from each feed stack. The system of the present invention helps to maintain the backlog or supply of articles to each proportional shifter supplied from a common article generator, such as a band oven, substantially the same. In embodiments of the invention the shifting of the number of articles removed from each stack, for example shifting from three to four articles and vice versa, may be performed every two to four minutes to maintain a substantially equal backlog of articles in each supply line.

The proportional shifter and article gauge unit 10 may be statically mounted along the infeed assembly 6 downstream of the backlog of rows of shingled product from the oven 20 and upstream of the RMS feeder 12. The proportional shifter and article gauge unit 10 may be mounted at attachment points 32 (FIGS. 5, 6A, 6B, and 7) on an appropriate stable surface such as a conveyor or other support for an infeed assembly 6. The article gauge 30 may be positioned either so that it attaches directly or indirectly to threaded block B as shown in FIG. 6A, or to threaded block A as shown in FIG. 6B, and should be positioned to allow gauge tray 34 to move as desired. As shown in FIG. 6B, the gauge 30 may be attached to block A via air cylinder 24.

Conventional or known article in-feeds may be used in the system and the method of the present invention. Where the product is, for example, graham crackers, the product infeed may comprise a conveyor belt leading through a band oven which bakes sheets of crackers. The baked cracker sheets may be scored lengthwise nine times at, for example, at five inch intervals and may then be cut width-wise at, for example, 2 ½ inch intervals, thereby forming a scored strip having a desired width. The cracker strips may then be conveyed onto a cracker breaker having a laterally undulating surface in which depressions are disposed underneath the scores of the cracker strip where they are broken by a downwardly moving punch at the score lines into nine rows of individual crackers. The nine rows of individual crackers may then be dropped from a faster conveyor to a slower conveyor where they overlap each other slightly to form edge rows of crackers. The nine rows of individual crackers lying on edge are then spread out by a row spreader to form rows or infeeds of slightly overlapping or shingled crackers that lie partly on edge. The nine infeeds of crackers shingled crackers may form or serve as a surge tank, backlog or supply as they approach the RMS feeder assembly 11. The supply may be permitted to temporarily buildup by increase the amount of overlap and increasing the vertical orientation of the shingled articles. The strip feeder 12 in the RMS feeder assembly 11 temporarily halts progress of the product to form a feed stack.

EXAMPLE

A method of using the proportional shifter 21 and article gauge 30 having a threaded block A pitch to threaded block B pitch ratio of 3:4 is illustrated in a non-limiting example, as follows:

FIG. 7 depicts how shifter and gauge unit 10 would work with 3 and 4-article picks, and a range of article thickness variation of 0.20 inches to 0.28 inches.

Thick Articles

Using article gauge 30 and fine tuning with thickness adjustment knob 23, shifter 21A is manually adjusted to pick four articles, each 0.28" thick, as shown in shifter and gauge unit 21A. An external pneumatic valve which operates air cylinder 24 switches shifter 21A from a 4-article pick to a 3-article pick shown as shifter 21B. The action of the valve moves article rest 28 up a total of 0.28", the thickness of one thick article, as shown by 31 in shifter and gauge unit 21B.

Thin Articles

Using article gauge 30 and fine tuning with thickness adjustment knob 23, shifter 21C is manually adjusted to pick four articles, each 0.20" thick, as shown in shifter and gauge unit 21C. Since each of the four articles is 0.08" thinner than the articles that are 0.28" thick, the article rest 28 is raised by (0.08"×4) or 0.32", shown in FIG. 7 as distance 33. An external pneumatic valve which operates air cylinder 24 switches shifter 21C from a 4-article pick to a 3-article pick, shown as shifter 21D. The action of the valve moves article rest 28 up a total of 0.20", the thickness of one thin article, as shown by 31 in shifter and gauge unit 21D.

The article gauge and proportional shifter system of the present invention may be used in circumstances where an article or product generator creates multiple streams of articles, and the articles are stacked on edge like a roll of coins. The article gauge and proportional shifter system can be used for a variety of applications and industries where articles are being stripped out of a chute or magazine for the purpose of counting or feeding. The system may be used for applications such as wrapping and sorting. The system finds use in industries, such as in making crackers, cookies, biscuits, snacks or other baked goods where the article thickness changes over time. The article gauge and proportional shifter system may be used with article infeed chutes, belts, or vibratory pans that are vertical, horizontal, or at any angle.

We claim:

1. A method for continuously packaging or sorting fragile articles having varying thicknesses in a stack comprising:

feeding a plurality of articles having varying thicknesses from an article infeed to one of a plurality of stripping devices, removing a set number of articles in the form of a stack by each stripping device, wherein a proportional shifter is coupled to each stripping device, measuring the stack height of said set number of articles with an article gauge attached to each proportional shifter and determining a change in stack height of said set number of articles, wherein said set number of articles are placed within the article gauge for said measuring of the stack height, and adjusting each proportional shifter for the change in the stack height in proportion to the set number of articles removed without interrupting the flow of articles, switching each said proportional shifter between two different pre-determined numbers of fragile articles which are removed by each stripping device, and maintaining the adjustment in stack height while said switching is performed in-process.

2. A method for continuously packaging or sorting fragile ankles having varying thicknesses in a stack according to claim 1 wherein the number of articles in a stack is set from about 2 to about 6 articles.

3. A method for continuously packaging or sorting fragile articles having varying thicknesses in a stack according to claim 1 wherein the two different predetermined numbers of articles in a stack is from about 2 to about 6 articles.

4. A method for continuously packaging or sorting fragile articles having varying thicknesses in a stack according to claim 1 wherein each proportional shifter is adjusted for a change in the stack height every 15 to 25 minutes.

5. A method for continuously packaging or sorting fragile articles having varying thicknesses in a stack according to claim 1 wherein said switching prevents depletion of a supply feed stack relative to at least one other supply feed stack.

6. A method for continuously packaging or sorting fragile articles having varying thicknesses in a stack according to claim 5 wherein said switching prevents depletion of a plurality of supply feed stacks relative to one another.

7. A method for continuously packaging or sorting fragile articles having varying thicknesses in a stack according to claim 1 wherein articles removed from a plurality of said stripping devices are stacked to form a slug.

8. A method for continuously packaging or sorting fragile articles having varying thicknesses in a stack according to claim 7 wherein said slug comprises from about 6 to about 18 articles.

9. A method for continuously packaging or sorting fragile articles having varying thicknesses in a stack according to claim 7 further comprising diverting an article infeed to a spare wrapper to accommodate product when a wrapper stops or breaks down.

10. A method as claimed in claim 1 wherein said articles are crackers.

11. A method as claimed in claim 1, wherein each proportional shifter comprises a rod with two blocks moveable along said rod.

12. A method as claimed in claim 11, wherein the rod comprises a threaded rod with two threads, each thread having a different pitch.

13. A method as claimed in claim 12, wherein the two blocks are threaded blocks, each block having a pitch that matches one of the pitches on the threaded rod.

14. A method as claimed in claim 13, wherein the pitches of the two threaded blocks differ by a factor equal to a ratio of two different pre-determined numbers of articles which are removed from said stack.

15. A method as claimed in claim 11, further comprising moving one of the blocks along the rod, thereby adjusting an article rest for the change in the stack height of said set number of articles.

16. A method as claimed in claim 11, wherein each article gauge comprises two plates, and wherein one plate is attached to one of the two blocks.

17. A method as claimed in claim 1, wherein each stripping device comprises a rotary material stripper feeder adapted to continuously sweep the set pre-determined number of articles into a wrapper.

18. A method as claimed in claim 1, wherein the proportional shifter comprises a variable smoke piston contained in an air cylinder.

19. A method as claimed in claim 18, wherein a distance moved by the variable stroke piston is limited by predetermined stroke stops.

20. A method as claimed in claim 1 comprising removing a number of articles from a stack which is different from the number of articles placed in the article gauge.

21. A method for continuously packaging or sorting fragile articles having varying thicknesses in a stack comprising:

feeding each of a plurality of stacks of articles from an article infeed to one of a plurality of stripping devices;

placing a set number of articles within an article gauge attached to each of said plurality of stripping devices and measuring the stack height of the set number of articles with the ankle gauge to set the number of articles for removal from a feed stack; and adjusting a proportional shifter attached to each ankle gauge for a change in the stack height of the set number of articles in proportion to the number of articles removed without interrupting the flow of articles.

22. A method for continuously packaging or sorting fragile articles having varying thicknesses in a stack according to claim 21 wherein the set number of articles in a stack is from about 2 to about 6 articles.

23. A method for continuously packaging or sorting fragile articles having varying thicknesses in a stack according to claim 21 wherein an in-process adjustment is made for the stack height of a set number of articles in each of said article gauges.

24. A method for continuously packaging or sorting fragile articles having varying thicknesses in a stack according to claim 21 wherein each proportional shifter is adjusted for a change in the stack height of the set number of articles every 15 to 25 minutes.

25. A method as claimed in claim 21 comprising removing a number of articles from a stack which is different from the number of articles placed in the article gauge.

26. A method as claimed in claim 21, wherein each said proportional shifter is switched between two different predetermined numbers of fragile articles which are removed by each stripping device while automatically proportionally compensating for changes in article thickness.

27. A method for preventing waste in continuously packaging or sorting fragile articles having varying thicknesses in a stack comprising:

feeding each of a plurality of stacks of articles supplied from an article infeed to one of a plurality of stripping devices, setting a plurality of proportional shifters each coupled to one said stripping device to remove a set number of articles from each feed stack in said infeed, placing a set number of articles within an article gauge attached to each proportional shifter, and measuring the stack height of said set number of articles with the article gauge, and removing a number of articles from a stack which is different from the number of articles placed in the article gauge.

28. A method for preventing waste in continuously packaging or sorting fragile articles having varying thicknesses in a stack comprising:

feeding each of a plurality of stacks of articles from an article infeed to one of a plurality of stripping devices, placing a set number of articles within an article gauge attached to each of said plurality of stripping devices, measuring the stack height of said set number of articles with the article gauge to set the number of articles for removal from a feed stack, and removing a number of articles from a stack which is different from the number of articles placed in the article gauge.

* * * * *

UNITED STATES PATENT AND TRADEMARK OFFICE

CERTIFICATE OF CORRECTION

PATENT NO. : 7,320,573 B2
APPLICATION NO. : 10/631360
DATED : January 22, 2008
INVENTOR(S) : Jones, Jr. et al.

It is certified that error appears in the above-identified patent and that said Letters Patent is hereby corrected as shown below:

At column 13, line 22 (claim 21 line 9) of the printed patent, “ankle” should be --article--.

At column 13, line 24 (claim 21 line 11) of the printed patent, “ankle” should be --article--.

Signed and Sealed this

Twenty-eighth Day of October, 2008

JON W. DUDAS
*Director of the United States Patent and Trademark Office*